United States Patent [19]

Svet, Jr. et al.

[11] 4,172,576

[45] Oct. 30, 1979

[54] HIGHWAY CROSSING SYSTEM WITH MOTION DETECTING APPARATUS

[75] Inventors: Frank A. Svet, Jr., Churchville; John W. Parker, Rochester, both of N.Y.

[73] Assignee: General Signal Corporation, Stamford, Conn.

[21] Appl. No.: 808,747

[22] Filed: Jun. 21, 1977

[51] Int. Cl.[2] ..... B61L 1/18

[52] U.S. Cl. ..... 246/128; 246/125

[58] Field of Search ..... 178/69.1; 246/34 R, 246/34 CT, 40, 114 R, 114 A, 125, 128, 130, 293; 325/58; 340/147 R, 171 R, 208; 343/6.5 R, 6.5 SS, 17.2 R

[56] References Cited

U.S. PATENT DOCUMENTS

| | | | |
|---|---|---|---|
| 3,246,143 | 4/1966 | Steele et al. | 246/128 |
| 3,610,920 | 10/1971 | Frielinghaus | 246/128 |
| 3,777,139 | 12/1973 | Peel | 246/125 |
| 3,781,541 | 12/1973 | Darrow et al. | 246/125 X |
| 3,987,989 | 10/1976 | Geiger | 246/125 X |

*Primary Examiner*—Stephen G. Kunin
*Attorney, Agent, or Firm*—Pollock, Vande Sande & Priddy

[57] ABSTRACT

A highway crossing warning system includes a motion detector transmitter and receiver respectively coupled to the track rails adjacent the highway crossing for detecting motion of an approaching train. Wrap-around approach sections initiate operation of the highway crossing warning, but once motion is detected, the motion detector can serve to inhibit the highway crossing warning, after a predetermined delay, if motion indication ceases. To increase the effectiveness of the motion detector, the motion detector transmitter impresses a modulated carrier onto the track rails, wherein the modulation is phase locked to the carrier. The receiver, tuned to the carrier frequency, detects the modulation, and then determines from the level of the modulated signal whether or not approaching motion is detected. The transmitter employs solid state circuits switched between saturated and off conditions to prevent circuit component failures from masking approach motion. The ring sustain time period is arranged to provide a minimum constant warning time regardless of changes in train velocity, so long as train velocity is maintained above a predetermined threshold within a predetermined distance from the crossing.

17 Claims, 21 Drawing Figures

FIG. 1
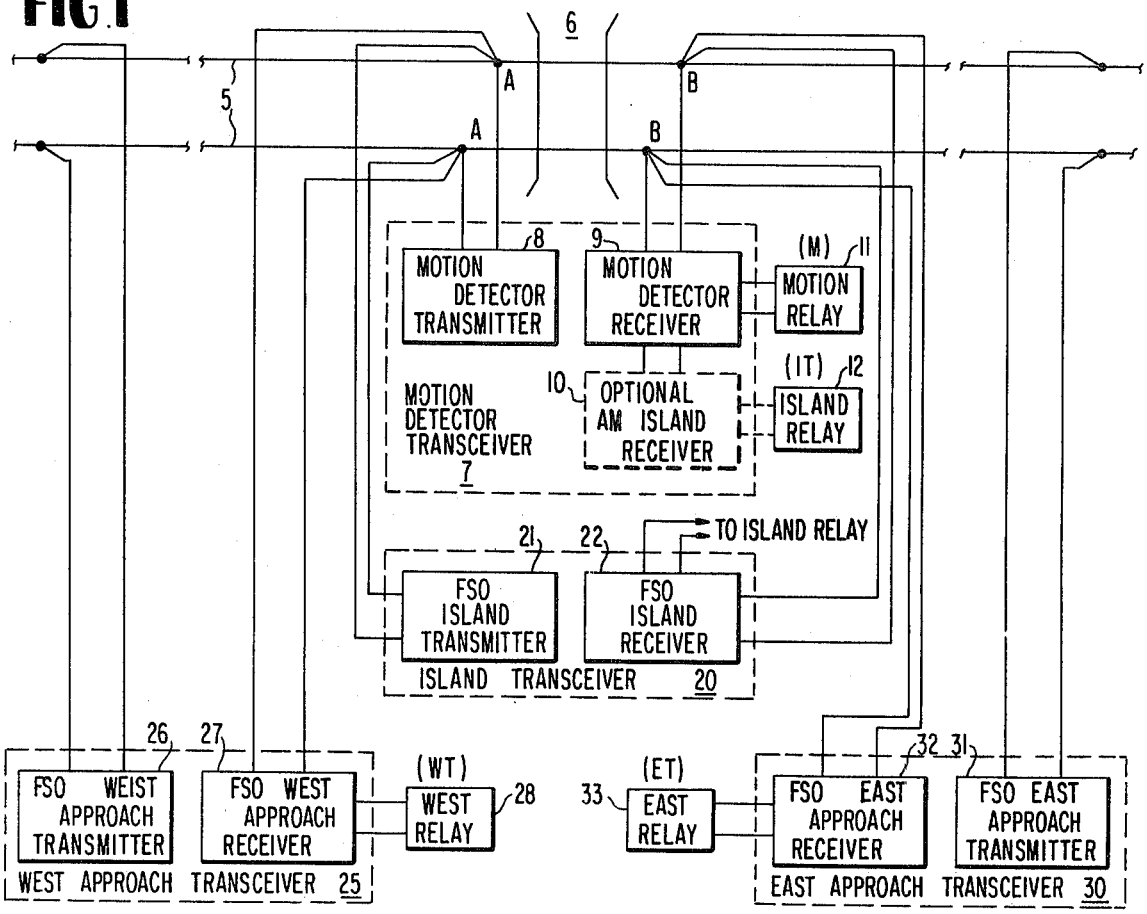
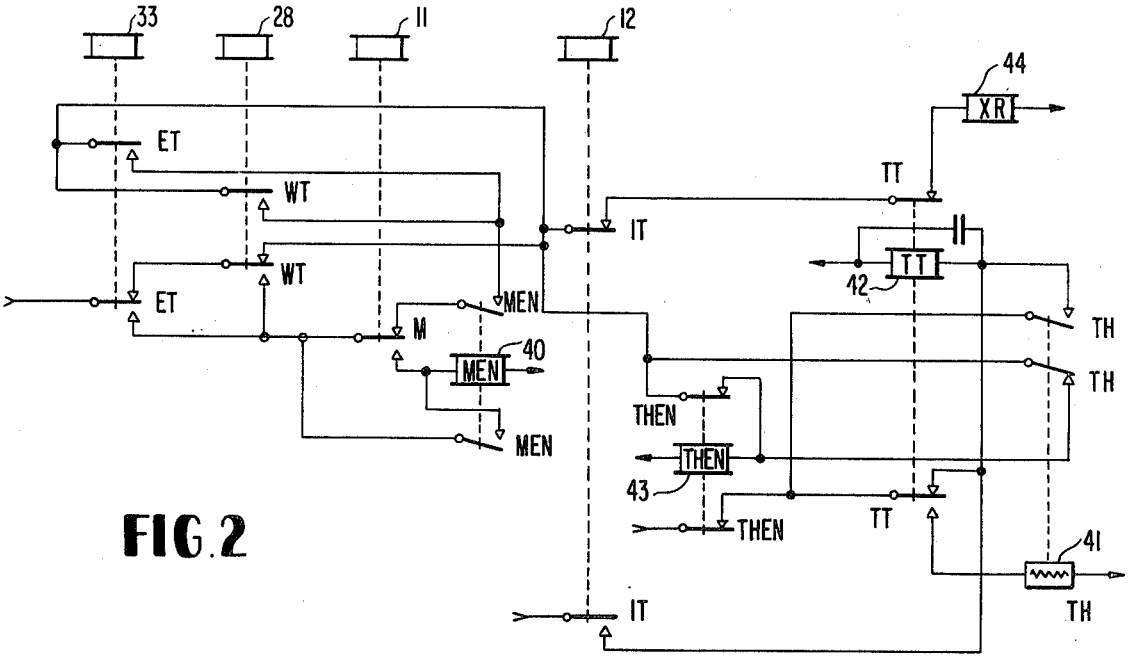
FIG. 2

MOTION DETECTOR
TRANSMITTER

MOTION DETECTOR
RECEIVER AMPLIFIER
AND BUFFER

RELAY DRIVER CIRCUIT

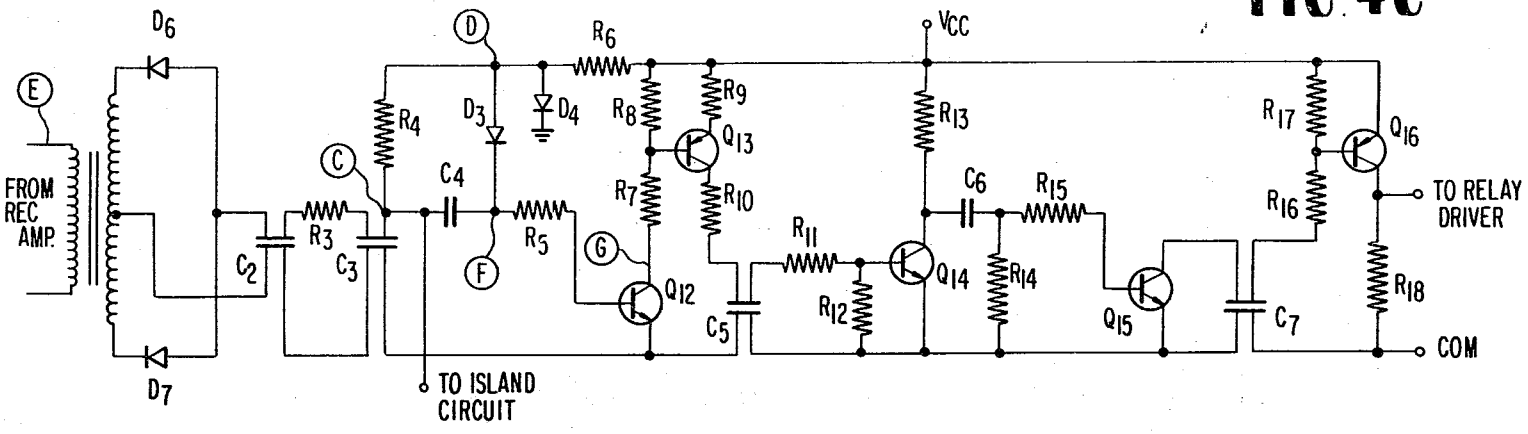
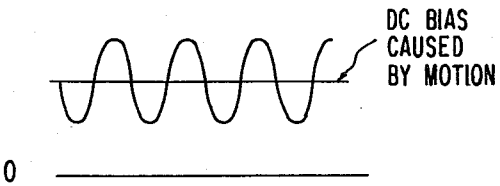
FIG. 9 VOLTAGE AT POINT F WITH APPROACHING MOTION
FIG. 7 VOLTAGE AT POINT F
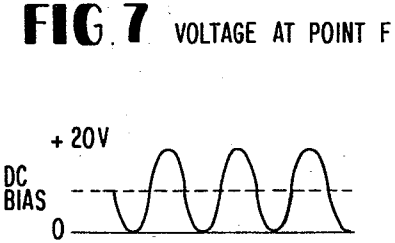
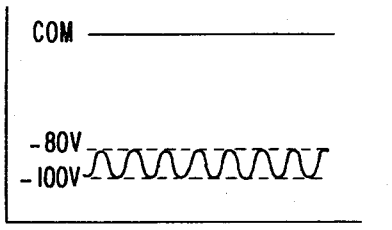
FIG. 5 VOLTAGE AT POINT C
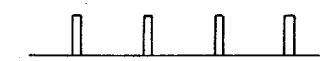
FIG. 8 VOLTAGE AT POINT G
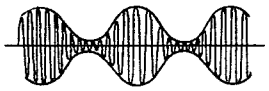
FIG. 6 VOLTAGE AT POINT E

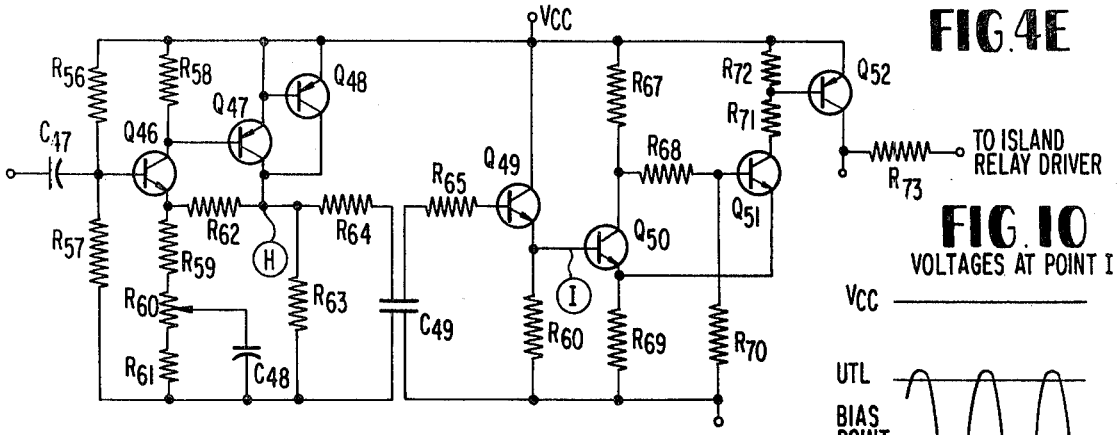
FIG. 4E
FIG. 10
VOLTAGES AT POINT I
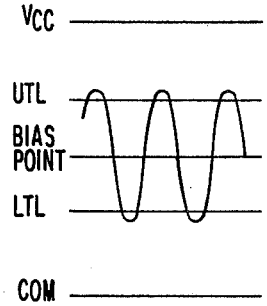
FIG. 11 TIME TO REACH CROSSING VERSUS DISTANCE FROM CROSSING AT WHICH MOTION BEGINS WITH CONSTANT ACCELERATION
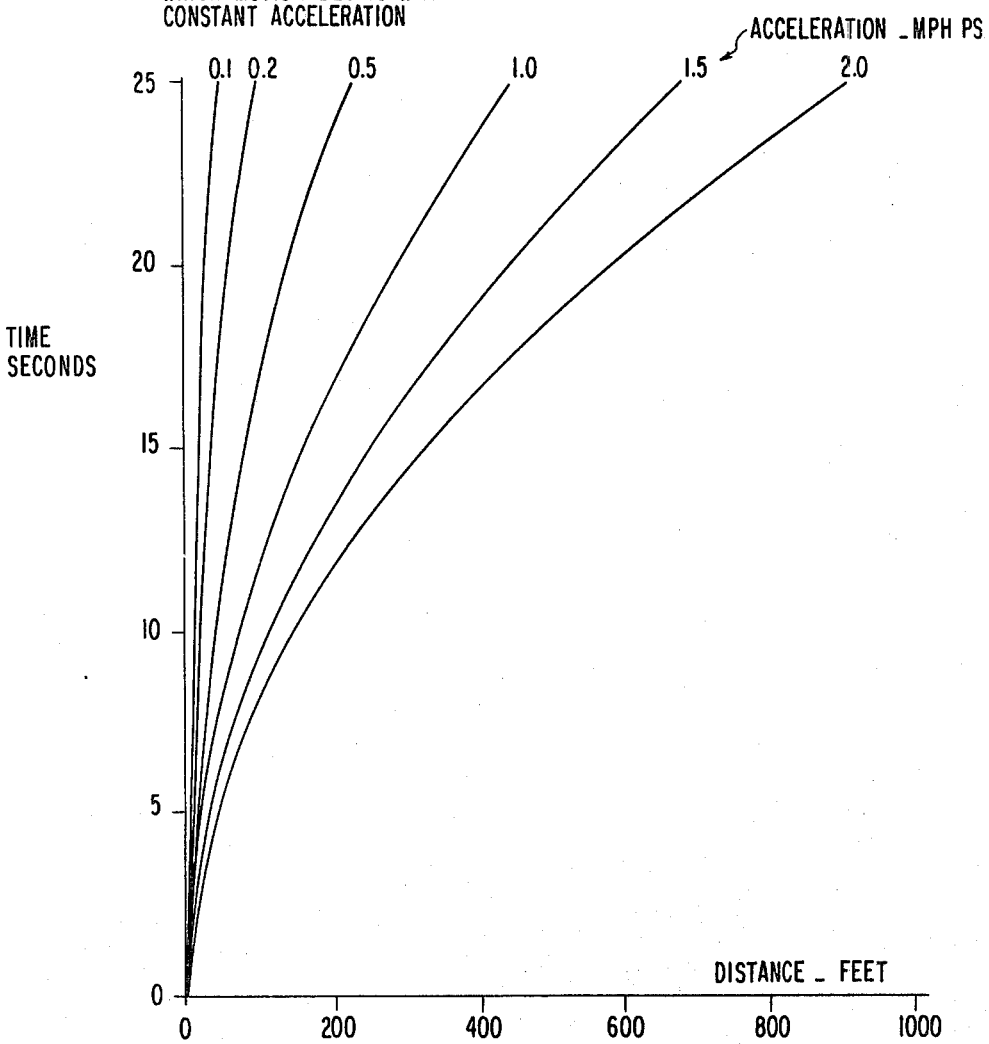

FIG. 16 MINIMUM WARNING TIME VERSUS MAXIMUM ACCELERATION FOR TRAINS WHICH STAY ABOVE 20 MPH

MOTION DETECTOR CHECKED AGAINST WRAP AROUND MOTION SPEED THRESHOLD DIRECTLY PROPORTIONAL TO DISTANCE FROM CROSSING.
NO MOTION DETECTION DELAY RINGING TERMINATES IMMEDIATELY WITH ABSENCE OF DETECTED MOTION.

HIGHWAY CROSSING SYSTEM WITH MOTION DETECTING APPARATUS

FIELD OF THE INVENTION

The present invention relates to highway crossing warning systems.

BACKGROUND OF THE INVENTION

The railroad-highway crossing, at a common grade, presents a potentially dangerous situation. Highway crossing warning systems have heretofore been developed to provide a warning to highway users of the approach of a train, with the desired goal of insuring that the crossing is clear at the time the railroad vehicle passes thereover. The problem of providing a safe and effective warning system is complicated by a number of variable factors.

AAR recommendations suggest that a minimum 20 second warning time be given of the approach of a train. Because the highway crossing warning system has no control over the speed of the approaching railroad vehicle, it must accommodate its operation to the motion of the railroad vehicle which can slow down or speed up as it approaches the crossing, indeed, the vehicle can even stop and start up again, such motion can be toward or away from the crossing. Furthermore, after the railroad vehicle has passed the crossing, the railroad vehicle may slow down, speed up, stop and then even reverse its motion and re-cross the crossing. The ideal highway crossing system should provide a minimum warning time regardless of these variations.

Further complicating the design of these systems is the variability which is inherently present under normal operating conditions. For example, one typical method of detecting the presence of a vehicle is the track circuit. The track circuit employs a source of electrical energy (DC, AC or frequency shift) which is applied to the track rails at one point and an electrical energy detector, such as a relay or other receiver, which responds to the energy impressed on the rails by the transmitter. The presence of a conventional railroad vehicle, with the steel wheel shunt it provides, alters the energy detected at the receiver, and this alteration is usually employed to signal the presence of a train. The track circuit is, however, subjected to variables other than the presence or absence of the train. For example, the track circuit is shunted through the ballast on which the rails are supported. This effective shunt is variable depending, for example, on moisture conditions. Furthermore, the conductivity of the track rails themselves may change their conductivity characteristics due to a variety of factors. One such factor, for example, is the presence or absence of rust in local spots on the rail.

Another type of arrangement which has recently become popular in highway crossing warning systems is the train motion detector. Whereas the track circuit employed the gross change in track circuit conditions caused by a train entering or leaving the track circuit to detect the presence or absence of the train; the motion detector, instead, relies upon the voltage variations at a receiver, as a train approaches or leaves the point at which the receiver is connected to the track rails, to detect train approach or departure. That is, train velocity is implied from the rate of change of voltage detected by the receiver. The variable factors affecting the track circuit also affect this type of operation.

Many of the older highway crossing systems employed insulated track sections. With the popularity of the welded rail, and the associated desire of the railroads to eliminate insulated joints, however, there is a desire to use non-insulated track circuits in the highway crossing warning system. As those skilled in the art will appreciate, the lack of insulated joints provides further variable factors inasmuch as now the changes in weather conditions can not only affect the nominal operating points, but can also affect the "range" within which vehicles can be detected.

Since the motion detector relies on amplitude information for motion detection, failures in the apparatus which have, or may have, the effect of increasing the modulation or amplitude level of the received signal are particularly dangerous. This is true for such failures could "mask" a reduction in the same quantity caused by approaching motion and thus prevent motion detection, when such detection should occur. It is therefore one object of the invention to provide a motion detector with a transmitter so arranged that failures in the transmitter circuitry will not result in increasing the modulation level or amplitude level of the transmitted signal.

Likewise, if a motion detector transmitter includes linear amplification circuitry, for example, to eliminate square wave harmonics to produce a sinusoidal signal, failure modes of that linear amplification circuitry could result in increasing the amplitude levels of the modulation signal or carrier. It is therefore another object of the present invention to provide a motion detector transmitter which eliminates the necessity for a linear amplifier.

Other failure modes in a transmitter include changes in oscillator frequency, failure of switching components such as dividers or switching transistors, and spurious high frequency oscillations. It is another object of the present invention to provide a motion detector transmitter which has circuitry arranged to prevent oscillator drift, failure of dividers or switching transistors, or spurious high frequency oscillations from producing increases in signal levels.

Prior art motion detector transmitters produce a modulated signal, i.e., a relatively high frequency carrier modulated by a lower frequency signal. If the carrier and modulating signal are separately generated, changes in relative phases of the modulating and carrier signals can result in variations in the transmitted signal of a relatively low frequency nature. Variations can produce the same effect on the motion detector as that of a train slowly oscillating back and forth in position. Hence, these variations may be considered as system noise which tends to mask the real signal and limits usable receiver sensitivity. It is therefore another object of the invention to provide a motion detector transmitter in which the modulating signal and carrier are synchronously generated, i.e., they are phase locked, thus eliminating low frequency variations in the transmitted signal as a result of relative phase changes between modulating and carrier signals and improving system signal to noise ratio.

As pointed out above, the motion detector responds to the modulating signal level. It is another object of the present invention to provide a motion detector in which the motion detector has a filter to prevent carrier energy from reaching the motion detector.

As pointed out above, some prior art highway crossing systems include wrap-around circuits in addition to a motion detector. Furthermore, it is conventional in highway crossing systems to include a detector for a so-called "island" circuit which is immediately adjacent the highway crossing on either side thereof, to insure that the crossing warning is energized whenever a vehicle is within the "island" region. The "island" receiver also serves to "reset" the logic of the highway crossing system as the train crosses over the crossing. Typical prior art systems included both a transmitter for the motion detector and a different separate transmitter for the island receiver. It is an object of the invention to provide a highway crossing warning system in which the motion detector transmitter energizes not only the motion detector, but also the island track circuit receiver eliminating the necessity for a separate island transmitter.

SUMMARY OF THE INVENTION

The present invention meets these and other objects of the invention by providing a highway crossing warning system with numerous desirable features. The motion detector transmitter is arranged so that failures in the transmitter do not have the effect of increasing modulation levels or amplitude levels of the transmitter signal. The transmitter employs switches, switching the full supply voltage and thus transmitter failure modes serve only to decrease the transmitted signal amplitude. Square wave harmonics are removed from the transmitter signal by employing a filter to generate sinusoidal signals. Accordingly, linear amplifier circuitry is not required to perform the square wave harmonic removal function. The presence of the filter also assures that oscillator drift, failure of dividers or gate in the transmitter, or spurious high frequency oscillations in the transmitter will only result in a reduction of the transmitter signal level. In the transmitter circuitry itself, a clock is employed, with appropriate division, to generate both the modulating signal and the transmitted carrier, and thus these are integrally related in frequency since they are derived from the same oscillator. Accordingly, variations in the transmitted signal as a result of relative phase variations between modulating signal and carrier are eliminated.

The motion detector receiver of the present system employs a carrier filter prior to the circuitry arranged to detect the modulation level and thus to detect motion. Accordingly, carrier energy is prevented from reaching the motion detector per se, and thus is unable to falsely operate the motion detector.

The highway crossing warning system of the present invention may also include an island circuit receiver which operates in response to the signals transmitted by the motion detector transmitter thus obviating the necessity for an additional transmitter to operate the island circuit receiver.

Finally, the motion detector includes a differentiating capacitor coupling the demodulated signal to an active stage. According to the invention demodulated dc signal level is arranged to bias the active stage to an off condition so that capacitor shorting results in a safe failure. This arrangement includes proper polarity selection for a full wave rectifier preceding the capacitor.

BRIEF DESCRIPTION OF THE DRAWINGS

The invention will now be described in connection with the attached drawings in which:

FIG. 1 is an example of a highway crossing system employing the invention;

FIG. 2 is a schematic showing one embodiment of the inventive timer cooperating with other elements of the crossing system of FIG. 1;

FIGS. 3, 4A, 4B, 4C, 4D and 4E are block and schematic diagrams of other components of the highway crossing system of FIG. 1;

FIGS. 5 through 10 are timing diagrams showing voltage waveforms at various locations in FIGS. 4A through 4E;

FIGS. 11 through 17 are various speed vs. distance profiles useful in explaining the invention.

DETAILED DESCRIPTION OF THE INVENTION

Figure 3:
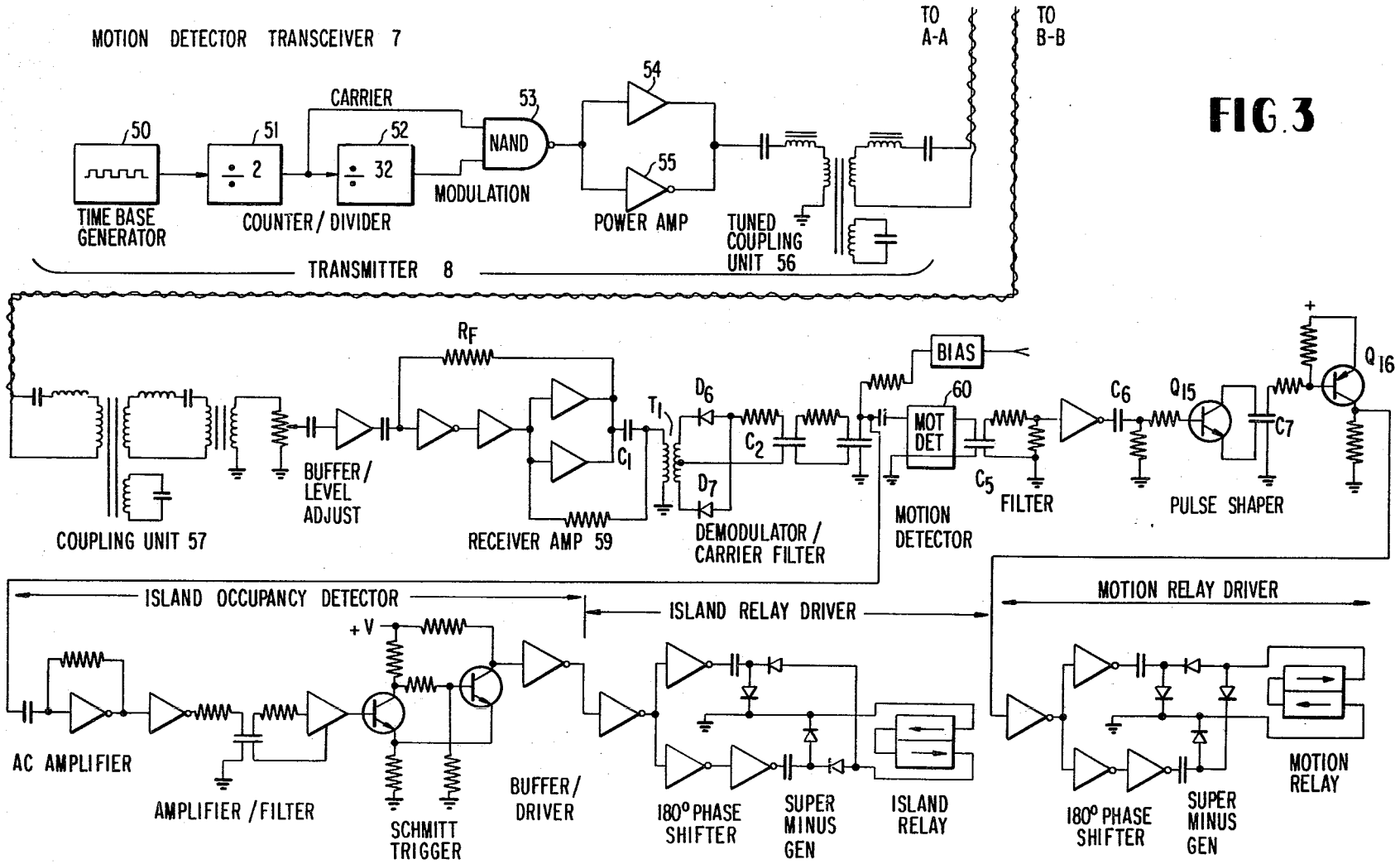

FIG. 1 is a block diagram of a highway crossing system in accordance with the present invention. As shown in FIG. 1, a pair of track rails 5 provide a path for a railroad vehicle. The rails 5 cross a highway 6 at a common grade, and accordingly, it is desired to provide a signal to users of the highway to warn them of the approach of a train vehicle, from either direction. In accordance with AAR specifications, it is further desirable to provide a minimum warning time regardless of the motion of the train, that is, regardless of whether or not it speeds up or slows down as it approaches the crossing, perhaps including actual stopping of the train and starting up again, in either forward or reverse directions. To effect this, a motion detector transceiver 7 is provided. Included within the motion detector transceiver 7 is a motion detector transmitter 8 having an output coupled across the track rails 5 at point A—A (some distance from the highway). A motion detector receiver 9 is also included within the transceiver 7 and the receiever 9 is coupled across the track rails 5 at point B—B (some distance from the highway 6 on the side opposite the side across which is connected the motion detector transmitter 8). The physical separation of A—A to B—B may be on the order of 100 feet.

An island transceiver 20 is also coupled across the track rails 5 at the same locations at which the transceiver 7 is connected. The island transceiver 20 may include, as illustrated, an FSO island transmitter 21, and an FSO island receiver 22. For wrap-around protection purposes, a west approach transceiver 25 is coupled to the track rails 5, including an FSO west approach transmitter 26 and an FSO west approach receiver 27. Likewise, on the opposite side of the highway 6 is an east approach transceiver 30 including an FSO east approach transmitter 31 and an FSO east approach receiver 32. As will become clear hereinafter, the island transceiver 20 can be eliminated if an optional AM island receiver 10 is included in the motion detector transceiver 7. Accordingly, the AM island receiver 10 is shown in dotted outline within the transceiver 7. Each of the receivers, that is, the motion detector receiver 9, the FSO island receiver 22, the FSO west approach receiver 27, the FSO east approach receiver 32, as well as the optional AM island receiver 10, are arranged to control the condition of an associated relay, such as motion relay 11, island relay 12, west relay 29, east relay 33. Of course, if the island transceiver 20 is eliminated, in favor of the optional AM island receiver 10, then that apparatus would control the condition of the island relay 12 as illustrated in FIG. 1.

In order to provide the wrap-around protection, FIG. 2 is an example of a relay diagram showing how the contacts of the relays 11, 12, 28 and 33 are arranged, and cooperate with a motion enabled relay (MEN) 40, thermal timer relay (TH) 41, time terminated relay (TT) 42, thermal timer enable relay (THEN) 43, in order to control the crossing relay (XR) 44. The relay diagram illustrated in FIG. 2 is not essential to the invention and those skilled in the art will be able, after reviewing this description, to provide other logic arrangements. In operation, assume that a west-bound train crosses over the east approach track receiver rail connections located a distance sufficient for adequate warning time from the protected grade crossing. The east track relay 33 releases because insufficient energy from the east track transmitter reaches the relay, due to the signal shunting of the train wheels and axles. When relay 33 releases the energy path to the crossing relay (XR) 44 is broken causing it to release. Release of relay 44, in conventional fashion, activates a warning device, such as lights, etc. (not illustrated). In addition, energy flowing to the thermal timer enable relay (THEN) 43 is interrupted, causing THEN relay 43 contacts to open. The opening of the lower illustrated contact removes energy from the time terminated relay (TT) 42 releasing it and opening its contacts. When the motion detector detects train motion toward the crossing for this train, it removes energy from the coil of the motion relay, M relay 11. Releasing of this relay provides energy to the motion enable relay (MEN) 40 which closes its contacts. Energy is still, however, withheld from the crossing relay 44, keeping the crossing warning device active.

Assume, at this point, that the train stops on the east approach. Relay 33 remains released because of train presence, but M relay 11 repicks closing its contacts, the MEN relay 40 remains energized through its own front contact. An energy path to the relay THEN is now completed through contacts of the relay ET, M, MEN, ET, and the normally closed contact of the relay TH. Thus, relay THEN repicks closing its own contacts. A stick circuit is established through the contact of THEN to the thermal timer TH 41. Energy, through the closed contacts of relay THEN and contacts of relay TT, flows to the thermal timer TH 41. The TH relay 41 is designed to operate, closing its normally open contacts after the heating element of the relay becomes sufficiently warm. This period of time is known as the ring sustain time. Thus, the ring sustain time delay keeps the crossing warning device active by withholding energy from the XR relay 44 for the prescribed ring sustain time. The importance of this feature will be discussed hereinafter.

When the timer (41) does time out, and closes its normally open contacts, an energy supply path is completed to the TT relay 42. This closes, supplying an energization to XR relay 44, and also opening the energy supply path to the TH relay 41. After a period of time, the contact of TH relay 41 opens, but the TT relay 42 is maintained energized through its own front contacts. The TH relay 41 cannot repick until it fully cools, thereby preventing short timing cycles. It is the delay to the repicking of the XR relay 44 imposed by TH relay 41 which is the ring sustain delay which will be discussed more fully hereinafter. While TH relay 41 is illustrated as a thermal relay, other apparatus can be employed to perform this timing function, for example, a motor driven timer could also be used.

As the train which had stopped again moves toward the crossing, its motion will be detected, again causing the M relay 11 to release. This opens the energization path for the XR relay 44 as well as the THEN relay 43. Furthermore, the TT relay 42 also releases. The crossing warning is again activated, due to the release of XR relay 44. When the train reaches the island track circuit the IT relay 12 releases. As a result TT relay 42 is re-energized. As the train enters the island, the WT relay 28 releases to maintain energy on the MEN relay 40 when the ET relay 33 repicks as the train clears the east track circuit. When relay 33 repicks energy is removed from TT relay 42; however, the TT relay 42 is slugged to provide slow release enabling the relay to maintain itself up for a short period of time, specifically, the time it takes for the M relay 11 to repick. After the train crosses the island, motion is away from the crossing, thus the M relay 11 repicks. This allows energy to flow to XR relay 44 as well as THEN relay 43. When THEN relay 43 repicks, energy is again supplied to the TT relay 42. Of course, when the XR relay 44 repicks, the crossing warning is terminated. However, should the train slow down and begin to back up, toward the crossing, the motion detector would drop the M relay 11 which would then de-energize the XR relay 44 again to initiate the warning. As the train clears the west track circuit, relay 28 repicks, removing energy from MEN relay 40, causing that relay to release and resetting the system for the next train.

Much of the apparatus shown in FIGS. 1 and 2 is an entirely conventional arrangement and no further description thereof appears necessary. For example, the approach transceivers 25 and 30 as well as the island transceiver 20 require no further description as those skilled in the art are capable of selecting and/or designing suitable apparatus. Likewise, the particular configuration of the various relays employed require no further description. Certain modifications can be made to the showing of FIG. 1 without changing the basic operating principles. DC approach circuits can be used in place of the illustrated FSO circuits, amplitude modulation can be employed instead of FSK, or the transmitter-receiver location can be interchanged.

However, the motion detector transceiver 7 will now be explained in detail. FIG. 3 is a detailed block diagram showing of the apparatus of the motion detector transceiver 7, including the motion detector transmitter 8 as well as the motion detector receiver 9 and the island receiver 10. Although the island receiver 10 (including island occupancy detector and island relay driver) is shown in FIG. 3, it will be recalled that, if employed, the island receiver shown in FIG. 3 can perform the function of the island transceiver 20, so that if island receiver 10 is present, the island transceiver 20 can be eliminated, or vice versa.

Figure 4A:
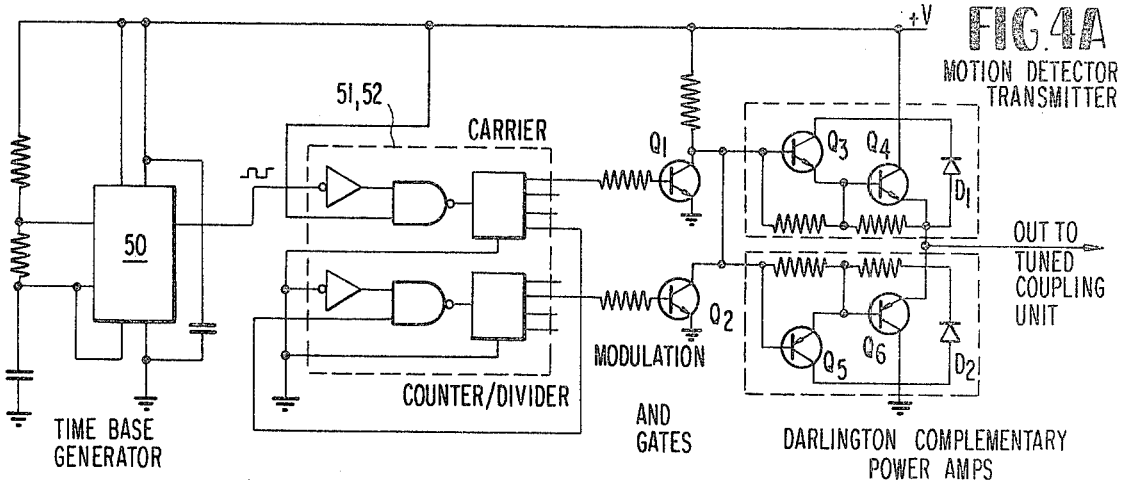

FIG. 3 shows the transmitter 8 in block diagram form including a time base generator 50 driving a one stage divider 51 whose output drives a further divider 52 and a gate 53. The output of the further divider 52 also provides another input to the gate 53 whose output drives a pair of power amplifiers 54 and 55 connected in parallel. The output of the power amplifiers is provided, through a tuned coupling unit 56, and connected to the track rails at points A—A. FIG. 4A shows the transmitter, in more detail, wherein the time base generator comprises a 555 integrated circuit 50 generating a continuous pulse train at a frequency which is twice the desired carrier rate. The output of the time base generator 50 provides an input to the divider 51, 52. The divider 51 divides the time base frequency in half, thus producing the desired carrier frequency with a 50% duty cycle. The CARRIER output is provided as one input to the gate 53 which, as shown in FIG. 4A, comprises transistors Q1 and Q2. The CARRIER signal is also fed back to the divider 52 to further subdivide the time base signal. The output of the divider 52 is the modulation signal which is also a square wave of 50% duty cycle. Inasmuch as the modulation signal is derived from the CARRIER signal, it has a constant time relationship or phase relationship with the CARRIER. The modulation input provides the other input to the gate, in this case transistor Q2. The collectors of transistors Q1 and Q2 are coupled together and provide the input signal to a Darlington complementary power amplifier comprising transistors Q3 through Q6 and including diodes D1 and D2. The transistors Q1 and Q2 are arranged to saturate if either the carrier or modulation input signal is high, and under those conditions, the output line, that is, the collector of transistors Q1 and Q2, will be at or near minus supply as a result of either transistor Q1 or Q2 being in saturation. The common collector output of transistors Q1 and Q2 will only be high if both the carrier and modulation input signals are at or near minus supply potential. Thus, the amplitude of the carrier is modulated by the modulation signal at a fixed rate and in synchronous manner. In other words, there are a fixed and integral number of carrier cycles transmitted for each modulation cycle. The output of the gate drives two Darlington configured power amplifiers connected with one Darlington amplifier in the emitter leg of the other amplifier. This emitter follower configuration alternately switches the tuned coupling unit 56 between plus and minus supply voltage. The coupling unit 56 is a fail-safe three pole bandpass filter with the pass band centered at the carrier frequency and bandwidth of approximately twice the modulation frequency. The resulting signal provided to the track connection is an extremely sinusoidal carrier with sinusoidal modulation. The second harmonic filter rejection is on the order of 50 dB, referenced to 0 dB in the filter pass band.

Figure 4B:
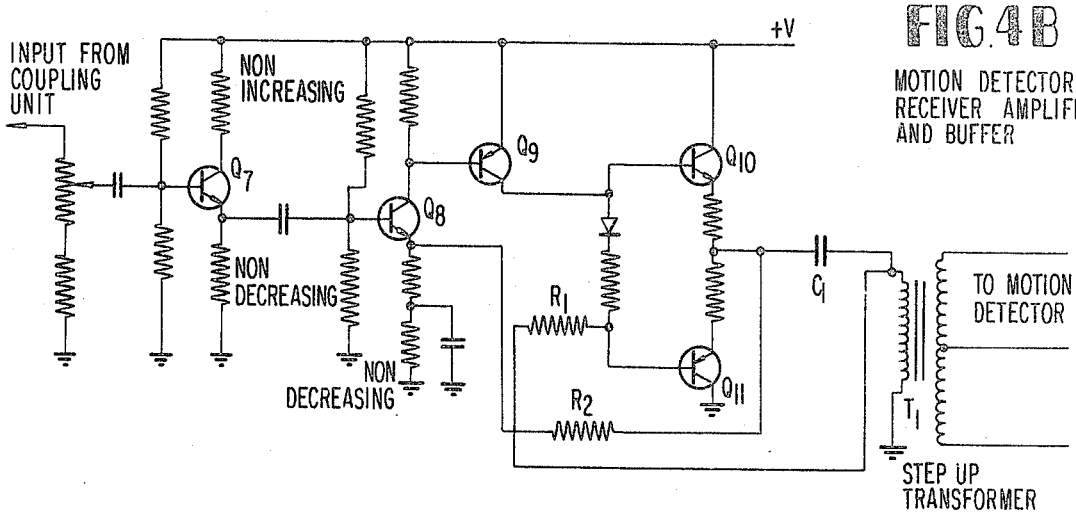

As shown in FIG. 3, the motion detector receiver 9 includes a tuned coupling unit 57, that is highly selective (3 pole bandpass) with bandpass centered at the carrier frequency and a bandwidth on the order of twice the modulation frequency. The output of the coupling unit 57 drives a buffer amplifier 58 whose output drives the receiver amplifier 59. The receiver amplifier 59 and buffer 58 are shown in more detail in FIG. 4B. Transistor Q7 provides a buffering and impedance matching function in its emitter follower configuration and is biased for linear operation. The output of the transistor Q7 drives a linear amplifier comprising transistor Q8 having a moderately high stage gain which in turn serves to drive the amplifier driver stage comprising transistor Q9.

A small forward bias is provided to the base of the power stage comprising transistors Q10 and Q11 in order to reduce the output signal distortion at the crossover point, i.e., where one transistor turns off and the other is turned on. The output of the power stage drives a large DC blocking capacitor C1 and a large step up ratio transformer T1. Positive feedback is provided for the stages including transistors Q9–Q11 by returning the resistor R1 to the common supply potential through the primary of the transformer T1. The four terminal resistor R2 provides for negative feedback including amplifier stages comprising transistors Q8–Q11. The overall closed loop gain for these stages is established as the ratio of R2 to the resistors in the emitter leg of transistor Q8, and thus the overall gain is not a function of transistor parameters, but rather a function of circuit resistance. Decreases in gain of individual transistors will decrease overall closed loop gain, i.e., a safe failure. The secondary of transformer T1 and the demodulator/carrier filter and motion detector 60 is shown in more detail in FIG. 4C.

FIG. 4C is a detailed schematic of the motion detector 60 and its associated components from the transformer T1 through the demodulator/carrier filter, motion detector 60, output filter and pulse shaper comprising transistor Q16. The secondary of transformer T1 is connected to the cathodes of diodes D6 and D7 to form a full wave rectifier, the output of which is coupled to a carrier filter including capacitors C2 and C3, and resistors R3 and R4, which form the carrier filter. The output of the carrier filter is coupled through a biasing network including diodes D3 and D4 to a motion detector 60. The output of the motion detector 60 is filtered by capacitor C5 and resistors R11 and R12, and then provided to an amplifier and pulse shaper including transistors Q14, Q15 and Q16. The output of the pulse shaper, at the collector of transistor Q16 drives the relay driver.

The output of the receiver amplifier is stepped up by step up transformer T1 to a level of several hundred volts. The full wave rectifier comprising diodes D6 and D7 provides for AM detection. A fail-safe RC filter removes the carrier frequency from the rectified signal and produces a waveform at circuit point C (FIG. 4C), as shown in FIG. 5. The illustrated signal is a modulation signal of approximately 20 volts peak to peak superimposed on a DC voltage of approximately minus 90 volts. The carrier filter, including resistor R4, is returned to ground through a diode D4 which itself is maintained in a conducting state by resistor R6 which is returned to the positive supply potential. Thus, a DC voltage of approximately 0.6 volts is maintained at circuit point D. This voltage, applied through resistors R3 and R4 to diodes D6 and D7, maintains these diodes in a conducting state even though the applied voltage (at circuit point E) may fall to a very low level.

The carrier filter, in addition to removing the carrier, also serves to reduce the level of the modulation signal. The output of the receiver is 100% AM modulated, as is the output of the transmitter. The frequency response of the RC filter reduces the level of the modulation signal produced at point C in order to increase the sensitivity. For example, the peak to peak voltage of the modulation signal is approximately 20% of the DC level produced at point C, see FIG. 5. Train motion produces changes in the voltage of very low frequency and these changes appear as changes in the DC level at circuit point C. The motion detector functions by using these DC offsets to suppress detection of the modulation signal. As a result, reducing the amplitude of the modulation signal with respect to the DC level results in greater sensitivity. However, the modulation level cannot be reduced indefinitely since enough modulation must be present to activate the system when there is no motion. This level becomes more critical as the motionless train is located closer to the crossing and the level of the track signal is significantly reduced by the shunt produced by the train. The motion detector 60 includes capacitor C4, resistor R5, diode D3 and transistor Q12. Under normal operations, with no train on the track circuit, the voltage at point C consists of the modulation signal riding on a large negative DC level (see FIG. 5).

As the modulation signal moves toward the negative peak (for example, approximately −100 volt DC) capacitor C4 charges through diode D3 and resistor R6. The anode of D3 is clamped to 0.6 volts by diode D4, and therefore the cathode of D3 when in conduction, is clamped to ground. The RC time constant of C4 and R6 is small compared to the frequency of the modulating signal and consequently C4 charges to nearly the peak negative value of the signal at circuit point C. As the modulation continues past its negative peak and starts toward its most positive value (for example, minus 80 volt DC) diode D3 becomes reverse biased, C4 begins to discharge through R5 and Q12, turning Q12 on. The voltage gain of this circuit is large, so that Q12 is maintained in saturation. The RC time constant of R5 and C4 is large enough so that during this discharge period, very little charge is lost from capacitor C4. Accordingly, as the modulation signal reaches its positive peak and starts toward its negative peak, D3 is maintained reverse biased and Q12 is held in saturation until the modulation signal very nearly reaches its negative peak. At that point, D3 turns on, causing C4 to recharge to its peak value and Q12 is turned off. Consequently, the motion detector produces a short pulse at the negative modulation peak. The signal at circuit point F is the modulation signal riding on a positive DC offset bias of approximately ½ the peak to peak amplitude of the modulation signal. The resulting waveforms at circuit points F and G are shown, respectively, in FIGS. 7 and 8.

When train motion exists, the track signal decreases in amplitude causing the demodulator signal at point C to decrease proportionately in amplitude. If the rate of decrease of the signal amplitude is greater than the discharge rate R5, C4 the positive DC level at point F increases, keeping the negative peak of the modulation signal from turning off transistor Q12 (see FIG. 9). Q12 is now held in saturation by the motion produced positive DC bias and the modulation pulses can no longer be passed through Q12.

The amplitude of the modulating signal at circuit point C also becomes smaller as the train approaches the crossing, and therefore a smaller and smaller DC bias offset is required of circuit point F in order to prevent the modulation signal from passing Q12. The DC offset bias is proportional to train speed and position of the train on the approach track; as a result, the sensitivity of the motion detector increases as the train approaches the crossing, or, in other words, the motion detector threshold is proportional to distance.

On the other hand, if the train is departing from the crossing, the track signal increases in amplitude, i.e., the amplitude of the signal at point C increases. Capacitor C4 charges rapidly through diode D3 to its peak negative value, the peak negative value of the modulation signal. Negative modulation peaks cause Q12 to turn off, and so modulation pulses appear at the collector of Q12. Accordingly, departing motion does not cause a loss of the modulation pulses at the collector of Q12. In this fashion, the motion detector differentiates between approaching and departing motion.

The polarity of diodes D6 and D7 insure that the voltage at point C will be negative with respect to circuit common. This is advisable to prevent possible false operation if C4 shorts. The negative potential, in this case, is coupled by the shorted capacitor to the base of Q12. Accordingly, the transistor will be inhibited from responding to any signal and the lack of modulation pulses will cause the M relay to release. This is a safe failure since the circuit has failed in its restrictive condition, i.e., an indication of motion. If, on the other hand, the diodes were reversed, the positive potential at point C, in the case of a shorted C4, would tend to turn Q12 on and an approaching train would cause switching of Q12 which will be interpreted as no approaching motion, i.e., an unsafe failure.

Transistor Q13 provides for current amplification when modulation pulses are produced by Q12. Resistors R10 and R11, and capacitor C5 comprise an RC filter network to filter out any high frequency signals. Q14 provides for squaring up the signal from the filter which is then applied to the differentiating network comprising R13, R14 and R15 as well as capacitor C6. The RC time constant of the differentiator is small enough so that a short current pulse is produced by the leading edge of the pulses appearing at the collector of Q14. The short pulse turns on Q15 for time sufficient to discharge capacitor C7 through Q15. After Q15 turns off, the capacitor C7 charges through resistor R16 and transistor Q16. Thus, Q16 is turned on providing a drive signal for the relay driver. The RC time constant of C7 and R16 is selected so that Q16 is turned on for a period of time equal to approximately ½ of the period of the modulation signal. Thus, the relay drive signal in the normal operation has a 50% duty cycle.

Figure 4D:
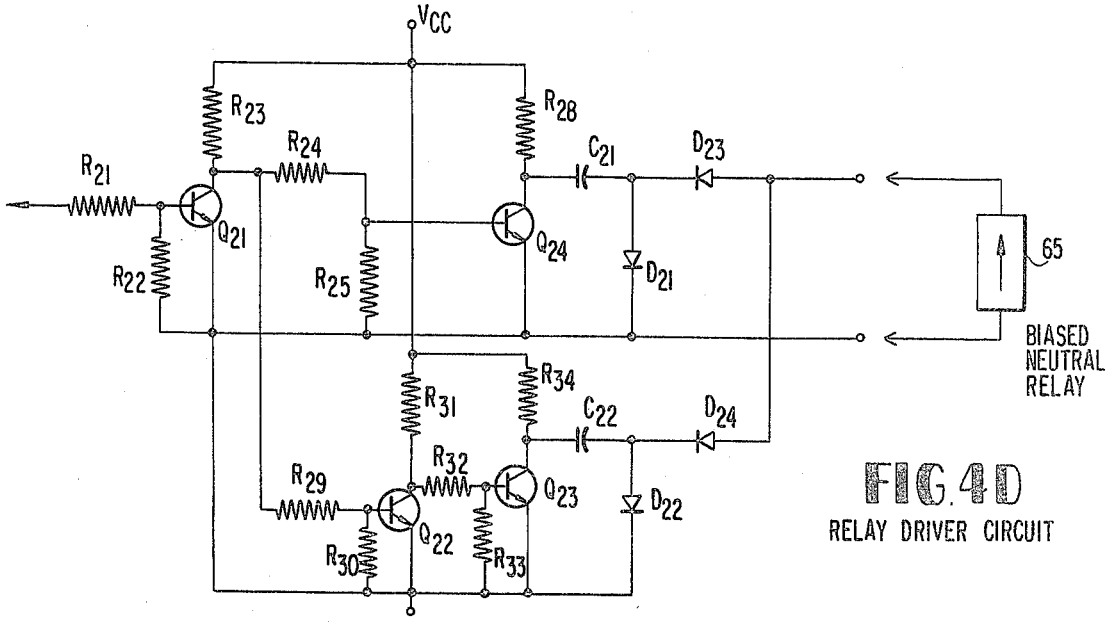

The relay driver, shown in block diagram form, at FIG. 3, is shown schematically in FIG. 4D.

The circuit drives a biased neutral relay such as relay 65. The input to the circuit is provided through resistor R21 which is connected to the base of a transistor Q21, comprising the first amplifying stage. Outputs from the collector of Q21 are provided to the base of transistor Q22 (through R29) and to the base of Q24 (through resistor R24). The collector of Q22 is coupled, through R32, to the base of Q23. Outputs are taken from both the collectors of Q23 and Q24 coupled respectively to one terminal of capacitor C22 and C21. The other terminal of capacitor C22 and C21 is connected, respectively, to anodes of diodes D22 and D21, whose cathodes are both connected to circuit common. The anodes of both diodes D21 and D22 are coupled to cathodes of diodes D23 and D24, whose anodes are coupled together and coupled to the negative input terminal of the biased neutral relay 65. With the relay coupled to the driver in the fashion just described, the driver must produce a more negative potential than that provided by system common, in order to pick the relay.

The modulation signal provided to the relay driver is coupled to one terminal of resistor R21 and thence to the base of transistor Q21. This transistor provides current amplification and applies the signal to drive transistors Q24 and Q22. Q22 inverts the drive signal and applies it to the base of transistor Q23. Thus, the two drive transistors Q23 and Q24 are driven 180° out of phase.

When Q24 is cut off, capacitor C21 charges through resistor R28, and diode D21. The RC time constant of this circuit is small compared to the time period of the signal and thus the capacitor charges to nearly the supply voltage. When Q24 turns on, the stored charge on capacitor C21 reverse biases diode D21 and C21 discharges through diode D23 and the relay coil. The operation of Q23, R34, C22, D22 and D24 is identical with the exception that it occurs 180° out of phase with the signal produced by Q24 and C21. As a result, a voltage negative with respect to common, is maintained at the output of the circuit. However, for this relay drive signal to be present, C21 and C22 must be alternately charged and discharged, assuring that the modulation signal is present when the relay is activated. While the optimum operating condition for the relay exists when the drive signal has a 50% duty cycle, operation is also possible with different duty cycles. With a different duty cycle, the circuit which is on for the longer period of time discharges to a lower voltage and may not be able to recharge to the full supply voltage during its reduced charge period. In this case, the average voltage supplied to the relay is reduced. As the duty cycle varies further from the 50% optimum, the average DC voltage will finally fall to a point which is below the relay drop-away level and the relay will release.

As mentioned above, the AM island receiver 10 is optional in that if present, it can replace the island transceiver 20. A schematic for the island receiver is shown in FIG. 4E. The input to the island receiver is connected to circuit point C (See FIG. 4C).

The purpose for the island receiver is to insure that the island relay 12 is de-energized when the track voltage falls below some fixed level which is indicative of a shunt or shunts across the track rails between the points A—A and B—B (see FIG. 1) or relatively close to points A—A or B—B.

The island detector input is provided through capacitor C47 to a feedback amplifier including transistors Q46, Q47 and Q48. The DC gain of the circuit is determined by the ratio of resistor R62 to the sum of resistors R59, R60, R61 and R62. R62 is a fail-safe four terminal resistor. The AC gain of the circuit is variable as determined by potentiometer R60 and the bypass capacitor C48. The maximum AC gain of the circuit is fixed by the ratio of R62 to the sum of the impedance of R58, C48 and R62. The DC bias level and gain are adjusted so that the DC voltage at the output of the amplifier, circuit point H, is fixed at approximately ½ the supply voltage.

Resistors R63, R64 and capacitor C49 (a four terminal fail-safe capacitor) comprise an RC filter to remove any spurious high frequency components. Resistors R65 and R66, and transistor Q49 comprise a unity gain emitter follower performing impedance buffering functions between the filter and the detector circuit.

The detector circuit, a Schmitt trigger circuit, includes transistors Q50 and Q51. The upper and lower threshold levels are determined by resistors R67, R68, R69 and R70. The DC bias point is adjusted so that the DC bias at circuit point I is halfway between the upper and lower threshold switching levels, i.e., see FIG. 10 which shows the relationship between the bias point, supply potential, circuit common and the upper threshold level (UTL) and the lower threshold level (LTL).

In order for an output to be produced, it must alternately switch between at least the UTL and LTL. Failures in the Schmitt trigger cannot cause the difference between UTL and LTL to decrease. The circuit is adjusted, at maximum sensitivity, and the minimum signal which will operate the detector is one with a DC level at the bias point and maximum positive swing which just touches UTL and maximum negative swing which just touches LTL. Any shift in the DC bias level or a shift in the threshold levels, makes the detector less sensitive, i.e., it requires either larger positive or negative voltage swing to actuate the detector. Transistor Q52, resistors R53, R72 and R73 amplify the voltage swing produced at the collector of Q41. The output of the circuit is applied to a relay drive circuit which can be identical to that disclosed in FIG. 4D.

The frequency of the transmitter plays a large part in the "range" of both motion detector and island detector, although as explained in "range" of the motion detector varies with train speed, that is, a fast moving train will be detected at a greater distance than a slower-moving train. Suitable frequencies for the transmitter are below 1 kHz and preferred frequencies lie between 160–760 Hz. At the low end of the frequency band, for example at 164 Hz, motion detector range for slow-moving trains is expected to be about 3000 feet and at the high end of the band detection is expected at 1000 feet to 1500 feet. The island receiver definition rang is expected to vary from 300 feet, at the low end of the frequency band to 100 feet at the high end.

Ring Sustain Time

The inclusion of both a motion detector and wrap-around protection, with logic of the sort shown in FIG. 2, provides a back-up for the motion detector operation. That is, if the motion detector fails for some reason, the crossing is still protected because the ringing of the crossing is initiated by the wrap-around protection. The motion detector is only allowed to inhibit ringing of the crossing after it has proven that it can detect motion.

But even in the absence of any failures, careful attention must be paid to the parameters of the system so that it gives the desired minimum warning time. For example, when a train enters the approach track, and is detected by the wrap-around circuits, the crossing warning is rung. If the train stops, and the motion detector operates properly, that is, it detects the motion of the train and it detects the stopping of the train, then the motion detector will be effective to terminate the ringing. Now, assume that the train starts up again; the amount of warning time provided will be the amount of time it takes for the train to move to the crossing. This can easily be less than the desired minimum warning time, especially if the train has been standing close to the crossing, or if it accelerates rapidly, or both. FIG. 11 is a plot of warning time versus distance from the crossing at which motion begins, assuming constant acceleration for various levels of acceleration. For example, a train which begins moving at a point 100 feet from the crossing with an acceleration of 0.5 miles per hour per second will arrive at the crossing with less than 20 seconds of warning. An obvious solution would be to extend the island circuit, since that causes ringing whenever it is occupied regardless of motion. However, extending the island sufficient to eliminate this problem can result in undesirably long values of ringing time after the train has crossed the crossing or for slowly moving trains. Another solution to the problem is required.

Referring again to FIG. 11, it should be noted that this presupposes a motion detector which indicates motion at the instant when motion begins and which can differentiate between zero speed and any arbitrary low speed, and perform this function with no delay. Of course, real motion detectors do not have these characteristics. Furthermore, the system must be arranged to absorb deterioration in motion detector sensitivity.

Particularly important is the motion detector which is sensitive enough to see the motion of an approaching train, but which is not sensitive enough to see the motion when the train reduces speed. For example, consider a motion detector whose speed threshold has deteriorated to the point that it only detects motion of trains travelling above 40 mph. If a train enters the approach track at 41 miles per hour, the motion detector proves its capability by sensing motion. Assume further than the train now slows to 39 mph, the motion detector believes the train has stopped. If allowed to terminate ringing of the crossing, the train moves onto the crossing at a speed of 39 mph. and ringing is not re-initiated until the train reaches the island track circuit. Substantially less than one second of warning time would be produced with such an arrangement. Motion detectors with sensitivity inversely proportional to distance reduce the problem to some extent. Due to the limitations on motion detectors, however, and in spite of the apparent AAR (American Association of Railroads) recommendation that at least a 20 second warning time be provided on at least selected highway crossings, it is apparent that a scenario can be constructed in which less than 20 second warning time will be provided regardless of the type of motion detector provided.

To handle this problem, therefore, the highway crossing apparatus is arranged to shoulder the responsibility for providing the minimum warning time if, and only if, the railroad train maintains at least a minimum predetermined speed (sometimes called the Rule speed), within a predetermined distance (sometimes called the Rule distance) of the crossing. If a train drops below this speed, then the apparatus is relieved of the responsibility for providing a warning time, and the train operator must assume this responsibility.

Figure 12:
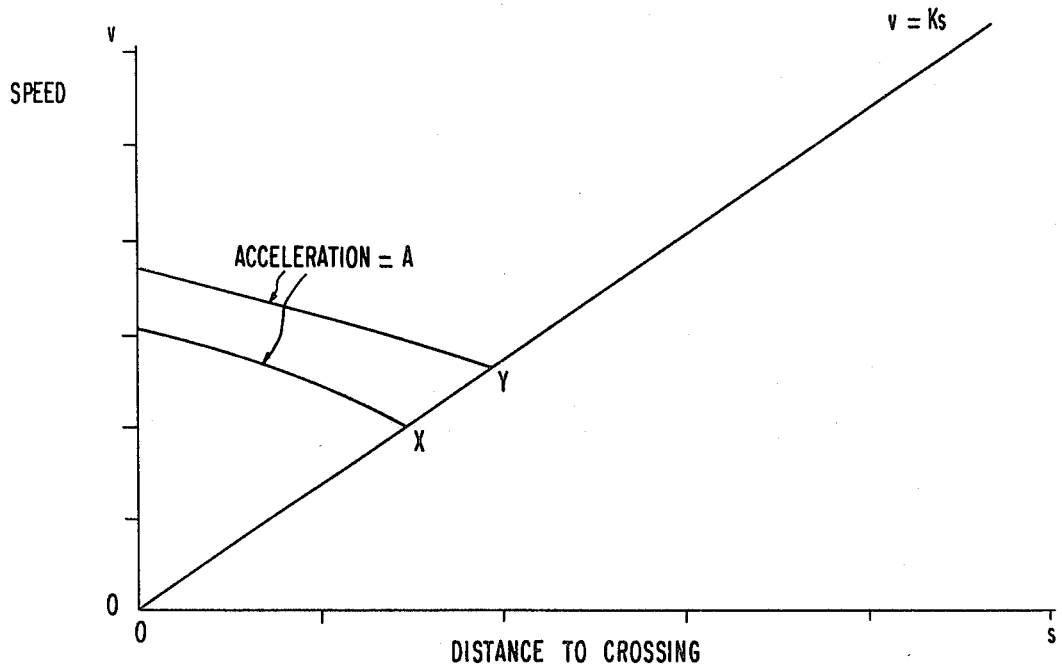

To examine the implications of such an arrangement, consider a situation wherein minimum speed referred to is identified by V, the distance is identified by S and K is the slope of the motion detector speed/distance threshold. In addition, the apparatus is to be arranged taking into account that the railroad train is subject to some maximum acceleration limit A and a maximum deceleration limit D. Under these circumstances, FIG. 12 is a plot of speed versus distance to the crossing. Positive speed denotes motion toward the crossing, and the speed profile of a train approaching the crossing is represented by a line. The train, as it approaches the crossing, moves to the left, and a point on the plot represents the position and speed of the portion of the train closest to the crossing. The diagonal line v equals Ks, represents the speed threshold of the motion detector, v represents the velocity of the train and s represents distance to the crossing. When the end of the train closest to the crossing (which will be hereafter referred to as the train) is above and to the left of the threshold line, the motion detector will sense motion and the crossing will ring. When the train is below and to the right of the threshold line, the motion detector does not sense motion. Specifically shown in FIG. 12 x and y are the speed profile of trains at different accelerations. As mentioned above, the motion detector will only be allowed to inhibit ringing if it has previously sensed motion for the train. When the train crosses the threshold line ringing again begins, and the warning time is the time it takes the train to move from the threshold line to the crossing. Thus, for any given crossing point on the threshold line, the minimum value of warning time will occur for a train which moves to the crossing with maximum acceleration A. The absolute minimum warning time will be represented by the particular line of acceleration A which has the shortest duration. It can be shown that the duration of these constant acceleration lines (and hence the warning time given at the crossing) decreases continually as the starting point moves closer to the origin. The shortest warning time for the illustrated value of K is the profile which begins and ends at the origin, and is simply a point. The corresponding warning time is zero.

Figure 13:
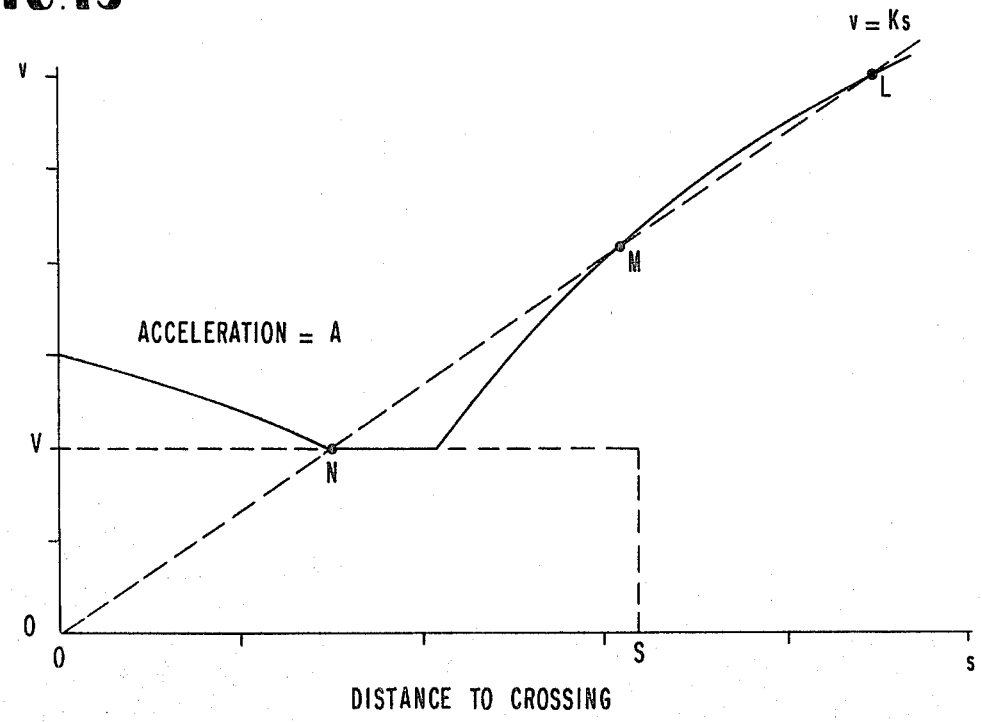

FIG. 13 illustrates a similar plot, but now we have represented the minimum speed V, and the distance S within which the train must exceed this speed in order to obligate the highway crossing apparatus to provide the minimum warning time. With this constraint, the shortest warning time is represented by the speed profile originating at the intersection of the threshold line with the line representing the speed V and proceeding to the crossing with acceleration A. In arranging this system it is imperative to know how the actual values of V, S, A and K affect the minimum warning time. If K can increase to infinity, minimum warning time decreases to zero. However, with excessively large values of K, the opportunity for the motion detector to sense any motion is extremely limited, and if motion is not sensed at all, then protection is provided by the wrap-around circuit. The situation which becomes of interest is shown in FIG. 13, wherein the speed profile of the train is such that, at point L, motion is detected, at point M motion detection terminates, and the train proceeds to point N before motion is again detected, and the warning time is the time it takes the train to travel from point N to the crossing with the maximum acceleration A. For this type of operation to be possible, the train has to decelerate at a sufficient rate to cross and recross the threshold line. Thus, the maximum value of deceleration is significant. For any given value of D, there is a corresponding value of K, matching each value of V, above which it is not possible to cross and recross the threshold without having the velocity decrease below V.

Figure 14:
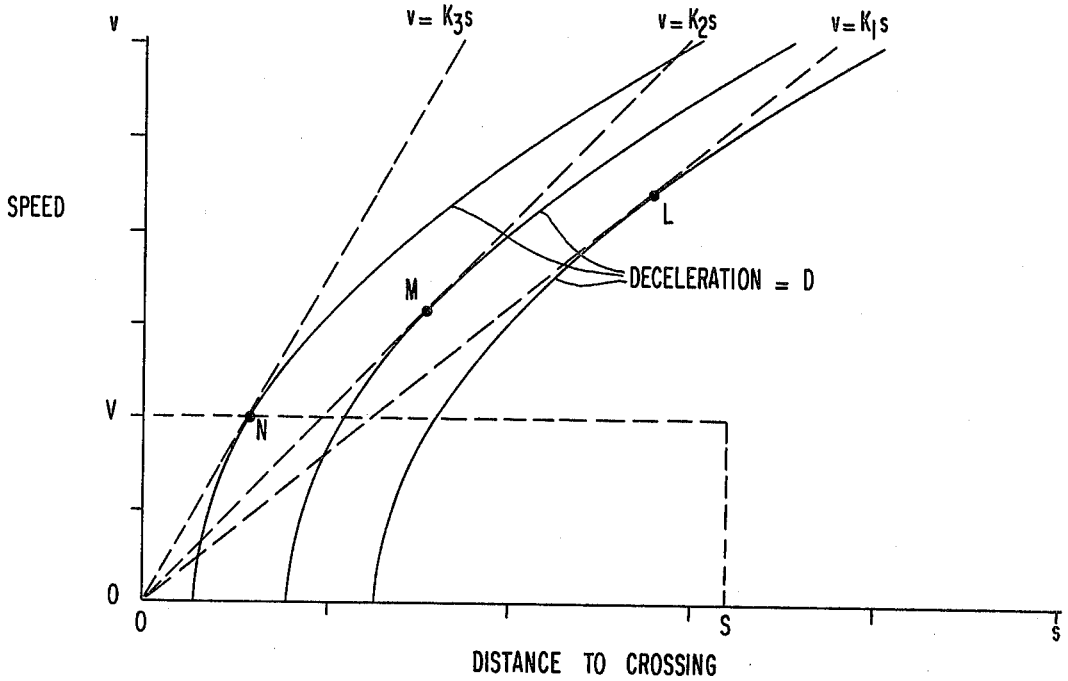

FIG. 14 shows three different threshold values of K; for each line the tangent deceleration is illustrated, that deceleration required to allow the speed profile to cross and recross the threshold line. When the tangency of the deceleration curve and the threshold line occur at speed V, such as point N in FIG. 14, a train crossing the threshold line cannot recross it without decreasing its speed below V. Hence, the maximum value of K that need be considered is that which matches the slope of the maximum deceleration curve at a speed V. That is, higher values of K will not decrease the minimum warning time because of the limit imposed by the maximum deceleration D.

The maximum deceleration is defined $V=\sqrt{2D(s-\Delta)}$ where $\Delta$ permits horizontal shifting of the deceleration curve. We can then write:

$$\frac{dv}{ds} = \frac{D}{\sqrt{2D(s-\Delta)}} = \frac{D}{v}$$

If we let $K=dv/ds$ when $v=V$ then $K_{max}=D/V$

Figure 15:
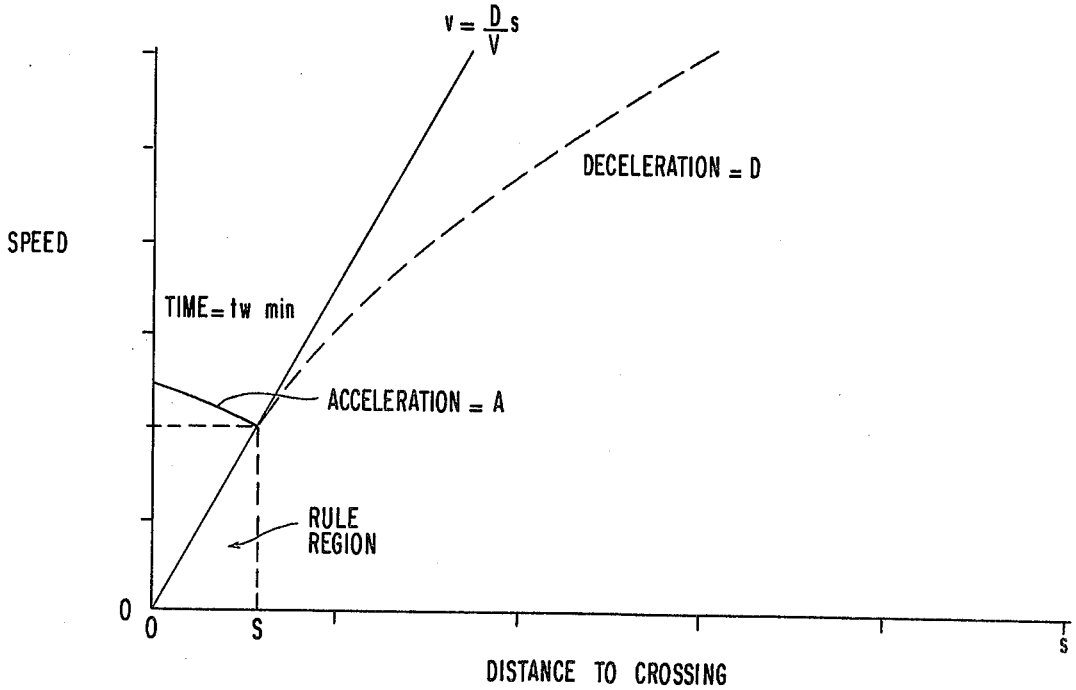

Therefore, the maximum value of K increases with increasing maximum deceleration and decreases with increasing speed V. FIG. 15 illustrates the minimum warning case. Based on the parameters of FIG. 14, the minimum warning time is:

$$t_{wmin} = \frac{\sqrt{V^2 + 2AS} - V}{A} = \frac{V}{A}\left(\sqrt{1 + 2A/D} - 1\right)$$

Figure 16:
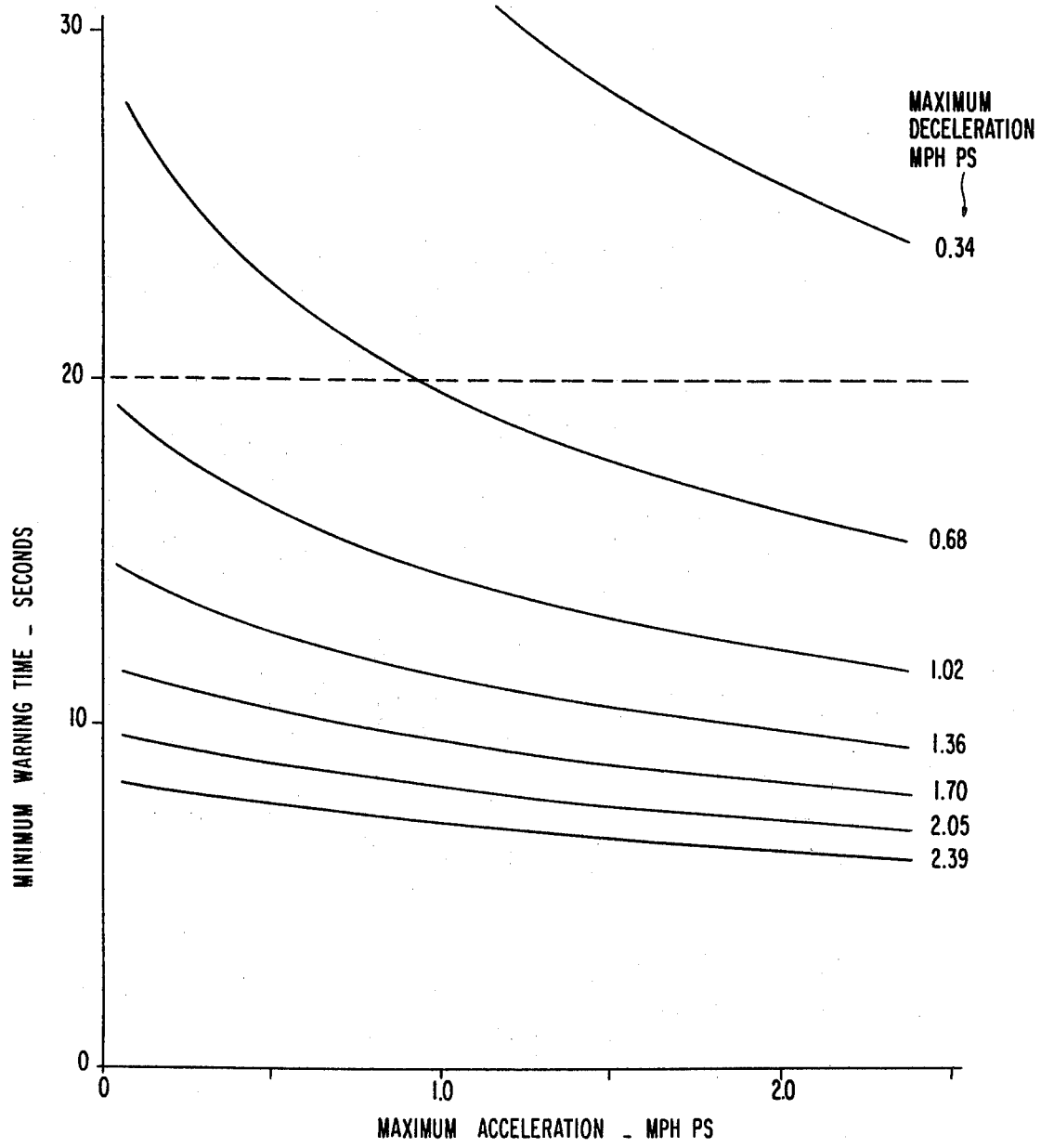

From the foregoing analysis, we find that once maximum acceleration A, maximum deceleration D, and speed V are defined, minimum warning time can be determined. Thus, in FIG. 16 we plot minimum warning time as a function of A and D for a speed V=20 mph. The horizontal dashed line indicates 20 seconds of warning time. For example, with a speed V equal to 20 mph, if maximum deceleration is 0.68 mph per second, maximum acceleration cannot exceed 0.93 mph per second. If maximum deceleration is 1 mph per second, no acceleration at all can be tolerated. While these limits are severe, they actually become worse if lower values of V are considered. To remedy this problem, we can determine for any given minimum warning time, $t_s$ (for example, 20 seconds) a value of K such that a move beginning at the intersection of the threshold line with the V speed and proceeding with maximum acceleration to the crossing is exactly equal to this minimum warning time. This value of K is $$K_c = 2V/t_s(2V + At_s)$$

Figure 17:
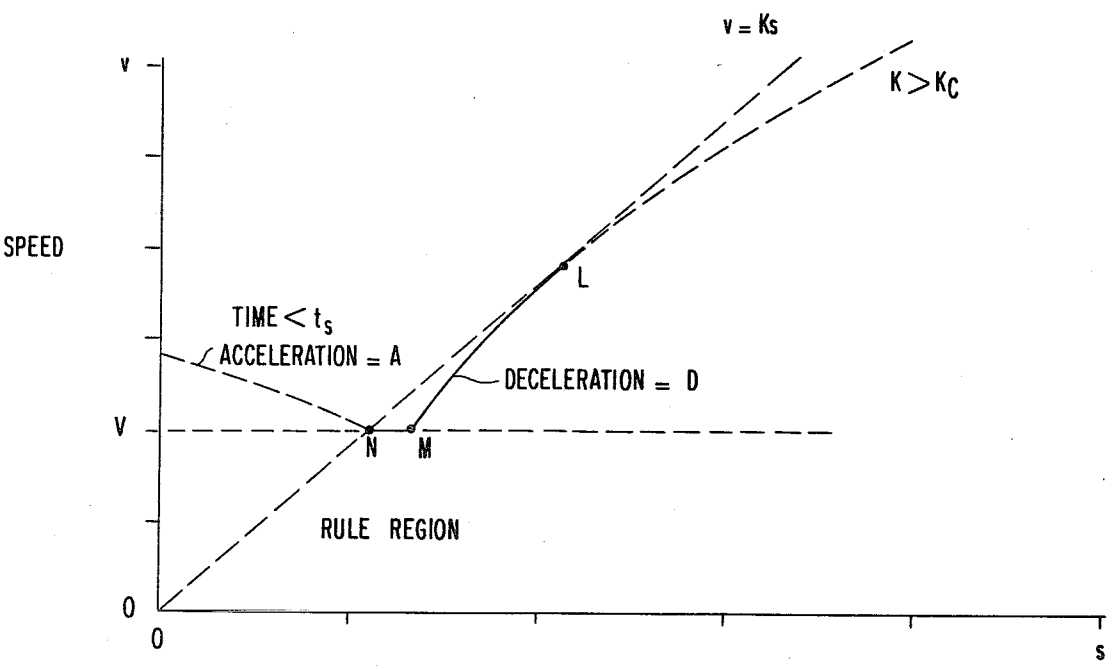

For all values of K which do not exceed $K_c$, the minimum warning time will be assured, so long as the train maintains at least a velocity equal to V. The remaining problem is to devise a solution for those situations wherein K is greater than $K_c$. FIG. 17 illustrates a case for $K > K_c$ with a deceleration at maximum, i.e., =D. Based on our preceding analysis, we know that the minimum warning time will be exceeded for all trains which proceed on a maximum deceleration profile displaced to the right of the illustrated profile because these trains will not be crossing the threshold line twice. For the tangent case, it is possible for the motion detector to indicate motion at point L, thereby proving itself, and stop indicating motion, slightly beyond point L, thereby inhibiting further ringing. When ringing started again at point N, there would be insufficient warning time if the train accelerated at maximum value, since we have postulated that K is greater than $K_c$. To assure minimum warning time, we introduce a delay in ringing termination, i.e, a delay in the time at which the motion detector is allowed to terminate ringing which delay equals or exceeds the time used in moving from point L to point N along the profile illustrated. The delay begins whenever motion is no longer detected and ringing continues until the delay is expired. In the case illustrated in FIG. 17, ringing would not stop at all since, prior to termination of ringing, motion would again be detected at point N. The specific time interval for the profile illustrated in FIG. 17 is adequate for all maximum deceleration profiles which are shifted to the left, since the shifted profile will result in less time from the loss of motion indication to the return of motion indication at point N. Thus, the time to follow the solid profile in FIG. 17 is adequate for all allowable speed profiles with this particular value of K. The necessary time delay, termed the ring sustain time ($T_{rs}$) is derived as follows. The slope of the deceleration curve is dv/ds=D/V This slope equals K when $v = v_L$; it follows that $$V_L = D/K \text{ and } S_L = V_L/K = D/K^2$$

We must also determine $S_M$ and $S_N$ as follows:

$$S_M = S_L - \frac{v_L^2 - V^2}{2D} = \frac{D}{2K^2} + \frac{V^2}{2D}$$

$$S_N = \frac{V}{K}$$

From this we determine the time required to move from L to N, defined as our ring sustain time ($t_{rs}$) as follows:

$$t_{rs} = \frac{v_L - V}{D} + \frac{S_M - S_N}{V} = \frac{D}{2K^2V} - \frac{V}{2D}$$

From this expression it is apparent that $t_{rs}$ increases as K decreases. However, we have shown that warning time will be adequate for $K > K_c$. Therefore, $t_{rs}$ for $K = K_c$ is adequate for any value of K. So our expression reduces to $$t_{rs} = \frac{D}{2K_c^2V} - \frac{V}{2D} = \frac{Dt_s^2(2V + At_s)^2}{8V^3} - \frac{V}{2D}$$

In order to be effective, the train must maintain at least a velocity V, within at least $S_M$. However $$S_M = \frac{D}{2K_c^2} + \frac{V^2}{2D} = \frac{Dt_s^2(2V + At_s)^2}{8V^2} + \frac{V^2}{2D}$$

We find that:

$$t_{rs} = (S_M/V) - (V/2D)$$

So the use of the ring sustain timer will provide minimum warning time $t_s$ so long as the train is limited to acceleration A, deceleration D and maintains at least a velocity V within $S_M$ of the crossing.

In summary, a timer is employed, which is initiated only when:

(1) motion has been detected; and, (2) motion detection terminates, before the train has reached the crossing or the island. We now do not allow the motion detector to terminate ringing when motion is no longer detected, but that event merely initiates the ring sustain timer, and the ringing is terminated only when the ring sustain timer expires.

By using the parameters discussed above we can assure any minimum warning time desired (so long as train velocity does not drop below the speed V) and is limited with maximum acceleration A and maximum deceleration D. This capability is true regardless of changes in the threshold of the motion detector so long as:

(1) the speed threshold remains directly proportional to distance to the crossing, and (2) the speed threshold does not change during the approach of any one train.

What is claimed is:

1. In a highway crossing system for warning highway traffic of the approach of a railroad vehicle, which system includes a railway vehicle motion detector, an improved transmitter for said motion detector including:

a clock source of electrical signals operating at a first rate, dividing means driven by said clock source, for producing at least one electrical signal at a rate which is a predetermined fraction of said first rate and which is phase locked to said clock source, a modulator connected to said dividing means for producing a modulated signal wherein the modulation is phase coherent with the signal being modulated, and means for coupling the modulated signal to track rails adjacent said highway crossing.

2. The apparatus of claim 1 wherein said dividing means produces a second electrical signal at a rate which is a second predetermined fraction of said first rate, wherein said first and second predetermined fractions are different, said modulator producing a modulated signal comprising said first electrical signal modulated by said second electrical signal.

3. The apparatus of claim 1 wherein said clock source produces electrical signals of square wave form and in which said means for coupling includes a band pass filter with the pass band slightly wider than twice the frequency of said modulating signal.

4. The apparatus of claim 3 in which said modulator includes an active circuit means having an output driven to saturation.

5. A highway crossing warning system for warning highway traffic of the approach of a railroad vehicle including a railway vehicle motion detector having a receiver and transmitter, said transmitter including:

a clock source of electrical signals operating at a first rate, dividing means driven by said clock source, for producing at least one electrical signal at a rate which is a predetermined fraction of said first rate and is phase locked to said clock source, a modulator connected to said dividing means for producing a modulated signal wherein the modulation is phase coherent with the signal being modulated, and means for coupling the modulated signal to track rails adjacent said highway crossing.

6. The apparatus of claim 5 wherein said dividing means produces a second electrical signal at a rate which is a second predetermined fraction of said first rate, wherein said first and second predetermined fractions are different, said modulator producing a modulated signal comprising said first electrical signal modulated by said second electrical signal.

7. The apparatus of claim 5 wherein said clock source produces electrical signals of square wave form and in which said means for coupling include a band pass filter with the pass band slightly wider than twice the frequency of said modulating signal.

8. The apparatus of claim 7 in which said modulator includes an active circuit means having an output driven to saturation.

9. The apparatus of claim 5 in which said receiver includes:

amplifying means coupled to said track rails adjacent said crossing, a demodulator coupled to said amplifying means, motion detector means coupled to said demodulator for detecting railway vehicle motion towards said crossing, and a railway vehicle presence detector coupled to said demodulator for detecting presence of a railway vehicle adjacent said crossing.

10. The apparatus of claim 9 wherein said railway vehicle presence detector includes filter means coupled to said demodulator and a voltage detector responsive to reductions in filter output voltage to below predetermined signal swings to detect railway vehicles.

11. The apparatus of claim 10 wherein said voltage detector comprises a Schmitt trigger circuit.

12. The apparatus of claim 9 wherein said demodulator includes a carrier filter and said motion detector means includes:

a motion relay driver, further filter means coupling signals to said motion relay driver, said further filter means limiting frequencies of signals coupled to said motion relay driver means.

13. In a highway crossing system for warning highway traffic of the approach of a railroad vehicle, which system includes a motion detector, an improved transmitter arranged to prevent circuit failures from increasing amplifier output comprising:

a source of signals to be transmitted including at least a carrier of determined frequency, output power amplifying means coupled to said source, including at least one active output device, switched by said signals between saturated and off conditions, tuned coupling means coupling said active output device to track rails adjacent said highway crossing whereby transmitter failures do not increase transmitter output at said carrier frequency.

14. The apparatus of claim 13 wherein said source provides a modulated carrier in which a modulating signal is phase locked to said carrier.

15. An improved motion detector for a highway crossing system in which a modulated signal is transmitted in track rails adjacent said crossing and a received demodulated signal is processed to detect approaching motion, said improved motion detector preventing potential unsafe failures and including:

a full wave rectifier, a differentiating capacitor, an active stage responding to demodulated signals from said full wave rectifier coupled through said differentiating capacitor, said full wave rectifier poled to reverse bias said active stage in event of shorting of said differentiating capacitor, whereby shorting of said differentiating capacitor provides a reverse bias on said active stage to inhibit masking motion detection.

16. The apparatus of claim 15 wherein said active stage includes a transistor poled to be reverse biased by potentials below emitter potential, and said full wave rectifier is poled to produce potentials below said emitter potential of said transistor.

17. The apparatus of claim 15 wherein said full wave rectifier includes a pair of diodes and an output terminal coupled to anodes of said diodes, said active stage including an npn transistor with emitter coupled to a common circuit ground, and circuit means including said differentiating capacitor coupling said full wave rectifier output terminal to a base of said transistor.

* * * * *